US008523436B2

(12) United States Patent
Armau et al.

(10) Patent No.: US 8,523,436 B2
(45) Date of Patent: Sep. 3, 2013

(54) FLEXIBLE SHIPPING CONTAINER AND MANUFACTURING PROCESS

(75) Inventors: Stephanie Armau, Ossun (FR); Cedric Lambert, Julos (FR); Mathieu Labedan, Bagneres de Bigorre (FR); Bernard Saint Martin, Louey (FR)

(73) Assignee: Sartorius Stedim Aseptics, Lourdes (FR)

( * ) Notice: Subject to any disclaimer, the term of this patent is extended or adjusted under 35 U.S.C. 154(b) by 668 days.

(21) Appl. No.: 12/599,897

(22) PCT Filed: May 13, 2008

(86) PCT No.: PCT/FR2008/000660

§ 371 (c)(1),
(2), (4) Date: Nov. 12, 2009

(87) PCT Pub. No.: WO2008/155483

PCT Pub. Date: Dec. 24, 2008

(65) Prior Publication Data

US 2010/0303389 A1 Dec. 2, 2010

(30) Foreign Application Priority Data

May 11, 2007 (FR) ..... 07 55036

(51) Int. Cl.
*B65D 30/00* (2006.01)

(52) U.S. Cl.
USPC ..... 383/37; 383/41; 383/66; 383/42

(58) Field of Classification Search
USPC ..... 383/36, 37, 41, 55, 56, 58, 66, 80, 383/109, 111, 901, 904, 906, 96; 224/148.1, 224/148.2; 604/327, 328, 332, 334, 337, 604/338, 339, 410
See application file for complete search history.

(56) References Cited

U.S. PATENT DOCUMENTS

| | | | | | |
|---|---|---|---|---|---|
| 611,207 | A | * | 9/1898 | Morrill | 383/3 |
| 2,548,359 | A | * | 4/1951 | Gandhi | 604/260 |
| 4,439,191 | A | * | 3/1984 | Hogan | 604/332 |
| 4,636,412 | A | * | 1/1987 | Field | 604/408 |
| 5,360,127 | A | * | 11/1994 | Barriac et al. | 215/263 |
| 5,634,721 | A | | 6/1997 | Moore | |

(Continued)

FOREIGN PATENT DOCUMENTS

| | | |
|---|---|---|
| EP | 0 688 020 | 12/1995 |
| FR | 2 721 289 | 12/1995 |

(Continued)

OTHER PUBLICATIONS

International Search Report dated Feb. 6, 2009, from corresponding PCT application.

*Primary Examiner* — Jes F Pascua
*Assistant Examiner* — Nina Attel
(74) *Attorney, Agent, or Firm* — Young & Thompson

(57) ABSTRACT

A flexible transport container (1) includes an inner bag (10) formed by a flat casing closed at one end (12), the other end (13) of which is folded towards the first end. The inner bag is housed inside an outer bag (20) formed by a casing provided with a first access port (25) which extends through the two bags close to the closed end of the inner bag and a second access port (27) which only extends through the wall of the outer bag opposite a portion of the folded end of the inner bag.

16 Claims, 1 Drawing Sheet

(56) References Cited

U.S. PATENT DOCUMENTS

| | | | | |
|---|---|---|---|---|
| 5,779,894 | A * | 7/1998 | Martensson | 210/232 |
| 5,853,207 | A | 12/1998 | Saint Martin et al. | |
| 5,941,640 | A * | 8/1999 | Thatcher | 383/22 |
| 6,082,585 | A * | 7/2000 | Mader et al. | 222/83 |
| 2005/0081950 | A1 | 4/2005 | Manlove | |
| 2006/0076251 | A1 * | 4/2006 | Hurst | 206/219 |
| 2006/0251343 | A1 | 11/2006 | True | |
| 2008/0272146 | A1 * | 11/2008 | Kaczmarek | 222/105 |
| 2011/0028924 | A1 * | 2/2011 | Murray | 604/332 |

FOREIGN PATENT DOCUMENTS

| | | | |
|---|---|---|---|
| GB | 2058011 | A * | 4/1981 |
| GB | 2 354 754 | | 4/2001 |
| WO | 2006133026 | | 12/2006 |

* cited by examiner

FLEXIBLE SHIPPING CONTAINER AND MANUFACTURING PROCESS

BACKGROUND OF THE INVENTION

1. Field of the Invention

The invention relates to a flexible container, in practice for single use for sterile applications, suitable to be used in particular for transporting products or small items such as piston joints or bottle stoppers as well as a process for manufacturing such a flexible container.

2. Description of the Related Art

In accordance with the document FR-2 721 289 (or EP-0 688 020, or U.S. Pat. No. 5,853,207), a device with a sealed junction between two chambers isolated from an external environment as well as a disposable chamber that is suitable for being used in such a device are known. Such a disposable chamber is basically mobile, while the other chamber can be a larger and heavier chamber, for example a sterilization chamber or a reactor. These chambers are each equipped with an opening that is equipped with a flange that is normally sealed by a door, and the sealed junction between these chambers uses the joint maneuvering of the two doors. These two doors are preferably for single use.

For practical reasons, these disposable chambers, also called disposable containers, generally consist of a combination of a rigid door (or cover) and a pocket (or bag) made of flexible plastic material, most often transparent. Such disposable containers can be used to transport all types of products, liquids, solids or powders to larger chambers (and even from the latter).

When these disposable containers are designed to transport products or small items, they can also comprise a second door, of the same type as the first, so as to allow the input of products or items via one of the doors, and the output of products or items via the other one of these doors.

If necessary, such containers make possible the application of a treatment with products or items that are contained therein, for example a sterilization treatment. This sterilization can be carried out by steam, by gamma-radiation, or by beta-radiation. Such a sterilization can be provided in particular when the containers are used for transporting small items, such as piston joints, stoppers, needle cases, etc., which are designed to be in direct contact with injectable products.

The requirements that relate to such containers first dealt with their strength, their sterilization capability (with steam or radiation), and their cleanliness. There were virtually no tests on the flexible containers (or packets).

Little by little, the requirements have been reinforced, and monitoring is henceforth conducted in an increasingly rigorous manner on these flexible containers. Thus, from now on, it may be possible to initiate monitoring on the particulate and/or endotoxin level. Furthermore, the generally relative idea of sealing (relative to gases, to water vapor, etc.) has gained importance.

It is thus, for example, that the users now desire to initiate monitoring of the integrity of films that constitute the flexible portion of the containers. Actually, it became desirable that the films not solely constitute barriers to microorganisms but also barriers to water vapor (in particular in the case of lyophilizates), etc. It should be noted that, by way of example, this monitoring is not satisfied when the films are made of a material that is based on fine high-density polyethylene fibers known under the trademark "TYVEK"® of DUPONT, making possible steam sterilizations.

Furthermore, the monitoring done at the manufacturing stages is, moreover, rigorous. Thus, in particular, the seams are no longer simply monitored visually, but also undergo sealing tests, in methylene blue, for example, pressure resistance tests, elongation tests, etc.

This is why the manufacturers of plastic films are all made to work—for the manufacturing of sheets or casings for containers—at cleanliness levels that continue to improve. Thus, it is easy to define the manufacturing, starting from an extruded casing, of simple flexible bags whose inside volume is specific: after the tube is extruded, it is sufficient to keep the casing flat and to weld it without having to manipulate it or to open it partway.

For the manufacturing of more elaborate containers, comprising access doors, such as disposable doors of the above-mentioned type, an effort is made to use the above-mentioned principle by adapting such doors to it while obtaining the same level of quality as with simple bags.

However, any intervention, whether it be human or not, is necessarily a source of contamination, reducing the quality of the casing in question. It follows therefrom that the assembling of one or more doors in a casing initially having a high level of cleanliness in principle involves a deterioration of this level of cleanliness.

BRIEF SUMMARY OF THE INVENTION

The invention has as its object to make it possible to obtain, with a high level of cleanliness, a flexible disposable container that is equipped with two basically disposable access doors, respectively designed for an input and an output of products or items, while allowing the application of treatments such as a sterilization treatment.

For this purpose, the invention proposes a flexible shipping container that comprises an inner bag that is formed by a flat casing that is closed at one end and whose other end is folded toward the first end, whereby this inner bag is housed in an outer bag that is formed by a casing that is equipped with a first access door that extends through the wall of the two bags, close to the closed end of the inner bag, and a second access door that extends only through the wall of the outer bag, opposite a portion of the folded end of the inner bag.

In other words, the container of the invention comprises an inner bag that shelters the products (or items), and an outer bag in which the inner bag is housed.

According to the preferred characteristics of the invention, optionally combined:

- The folded end of the inner bag is shaped like an elephant's trunk, narrower than the rest of the inner bag, which facilitates the output of products or items that are contained in the inner bag,
- The inner bag has a width that is at most equal to that of the outer bag, which makes it possible for the inner bag to be completely filled (if necessary), inside the outer bag,
- The two bags are connected close to the first closed end of the inner bag, therefore close to the first door, which contributes to easing the load supported by the connection that is ensured between the door and the walls of the two bags,
- The two bags are connected by welding, which corresponds to a well-known connecting method that complies with the criteria of cleanliness and sealing, in particular,
- The two bags are connected close to the folded end of the inner bag, which promotes holding the second end in folded configuration while the inner bag is filled,
- The access doors are disposable doors, which contributes to ensuring that the container cannot be used a second time, by mistake, The inner and outer bags are made of different materials, one of which has a particulate holding capacity, and the other has mechanical protection properties, which makes it possible to distribute the various functions asked of the container between the two bags.

The invention also proposes a process for manufacturing such a container, namely a process for manufacturing a container of the above-mentioned type, according to which a first flat casing is made by providing there, close to a first end, a hole that extends through a single wall of this casing, and by folding the other end, a ring is slid inside this casing from the first end so as to extend through this hole; furthermore, a second casing is made in which two holes are made; a first access door is engaged in one of the holes, and another access door is engaged in the other hole, whereby the first door, after the inner bag is inserted into the outer bag, is connected by ratcheting to the ring while the second door is opposite the folded end of the first casing.

This process accepts preferred characteristics, optionally combined, analogously to those that are disclosed above in connection with the container; in particular:

The folded end is shaped like an elephant's trunk,

The two casings are connected close to at least one of the ends of the first casing, The two casings are made of two materials, one of which has a particulate holding capacity and the other has mechanical protection properties.

BRIEF DESCRIPTION OF THE DRAWINGS

Objects, characteristics and advantages of the invention emerge from the following description, provided by way of illustrative, nonlimiting example, with regard to the accompanying figures in which.

DETAILED DESCRIPTION OF THE PREFERRED EMBODIMENTS

Figure 1:
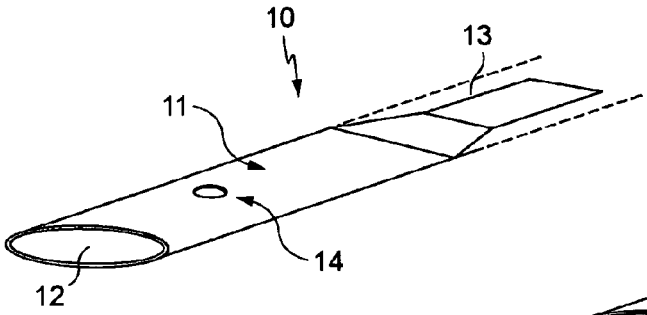
FIG. 1 is a perspective view of a casing that is suitable for forming the inner bag of a container according to the invention.

FIGS. 1 to 5 show stages for manufacturing a container in accordance with the invention: this container, denoted as 1 in its entirety, comprises an inner bag 10, completely housed in an outer bag 20.

The inner bag 10 is made from a flexible casing 11 that is totally flattened in shape (its wall therefore forms two layers that are superposed and in contact with one another so as to reduce the inner volume of this casing), which is cut so as to have first and second ends. One of the ends, denoted as 12, is left intact, while the other end is modified here, by constriction, for example by welding from the outside so as to form the shape of an elephant's trunk, denoted as 13, with a smaller section than the other end. Furthermore, a hole 14 is formed in the upper layer of the wall of the inner bag, close to the first end, for example using a hollow punch (see FIG. 1).

It shall be understood that it is only for the sake of legibility of the drawings that the end 12 is shown as open to a large extent, since it was specified that this inner bag is normally flattened.

It should be noted that these operations, carried out from the outside of the casing 11, do not contaminate the inside of the inner bag since it can remain totally flattened to the point of not allowing the entry of anything.

A rigid ring 15 is then (see FIG. 2) slid into the casing from the first end 12 until it is fitted into the hole 14. This ring is made of, for example, rigid plastic material, obtained by injection under conditions of great cleanliness.

Figure 2:
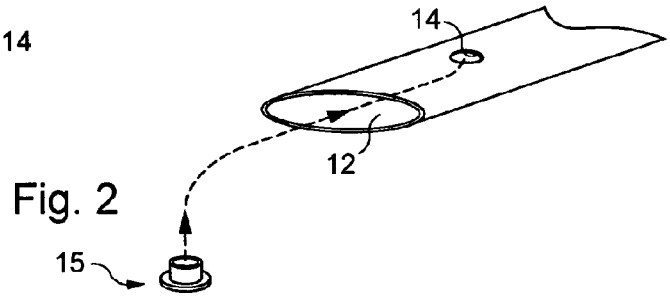
FIG. 2 is a partial view thereof showing a portion that accommodates a ring that is designed to be assembled at an access door.

As will become evident below, this operation of installing the ring is the only one that can allow the cleanliness of the interior of the inner bag to degrade since it involves opening the casing partway between the end 12 and the hole 14 (this action of opening the casing partway is exaggerated in FIG. 2, by analogy with FIG. 1). However, such a degradation is insignificant since this preparation is performed in a clean room.

The outer bag 20 is formed by a casing, basically slightly wider than the casing 11, so as to allow an easy insertion of the casing 11.

Figure 3:
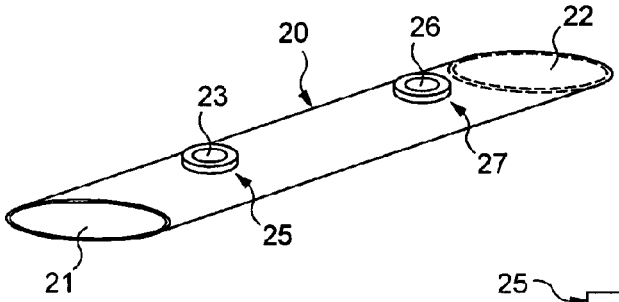
FIG. 3 is a view of the casing that forms the outer bag of the container.

This outer bag 20 is obtained here by simple cutting of a flexible tube, and its two ends 21 and 22 are open here (see FIG. 3).

This outer bag comprises two holes, one of which (23) is able to come opposite the hole 14 of the inner bag, and comprises an access door 25 that works with a hoop 24 that works with the access door so as to sandwich the periphery of the hole 23. Here, by ratcheting, this door 25 is suitable for working with the rigid ring 15 (see below with regard to FIG. 4) and thus for ensuring a connection between the two bags. The other hole 26, designed to come opposite the section that is shaped like an elephant's trunk, is equipped with an access door 27, basically identical to the access door 25.

These two access doors 25 and 27 are advantageously disposable, such as is described in, for example, the document EP-0 688 020 that is cited above. It shall be understood that, by the concept of access door, the meaning here is the combination of a stationary flange relative to at least one of the bags and a mobile seal that is suitable for sealing, or not, the opening that is formed by the flange.

The first access door 25 is designed for the loading of products or small items while the second access door 27 is designed for unloading these products or small items, by means of the section that is shaped like an elephant's trunk.

This outer bag can be prepared under conditions that are less clean than the inner bag.

Figure 4:
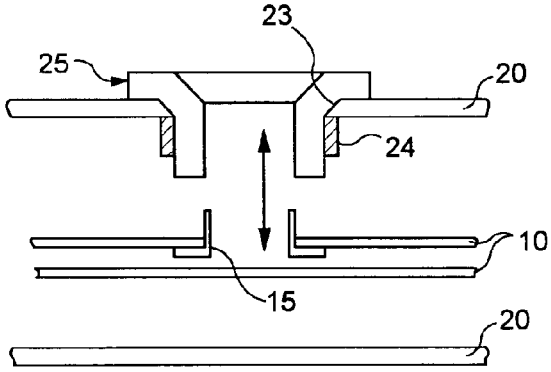
FIG. 4 is a partial cutaway view of the container at the time of assembling a door at the ring.
Figure 5:
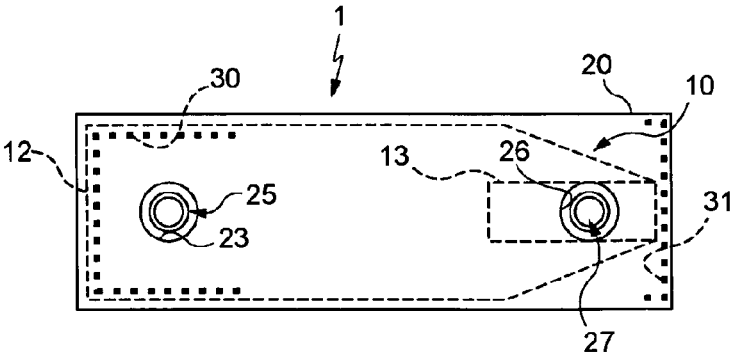
FIG. 5 is a top view of the complete container.

By opening the casing partway via one of the ends 21 or 22, the container manufacturer can then insert the inner bag there, after having folded the section that is shaped like an elephant's trunk, by sliding the thus folded unit; the door 25 is then ratcheted on the rigid ring 15 (see FIGS. 4 and 5). Although it is conceivable that the mounting of two doors could be done after the inner bag is inserted into the outer bag, it should be noted that the fact that it is now necessary, after the inner bag is slid into the outer bag, only to connect the first door to the rigid ring by ratcheting has the advantage of reducing the risk of degradation of the inner bag because of it being assembled with the outer bag.

It can be noted that, although it is provided in FIG. 4 that the door 25 is ratcheted on the ring 15, it can equally be provided that the ratcheting takes place in this ring.

In practice, the two bags are both made of plastic materials.

It can be noted that, from the time the inner bag has slid into the outer casing, and when the first access door 25 has been connected by ratcheting to the rigid ring 15, the inside of the inner bag is protected with regard to any outside contamination since the hole 13 is now blocked by the access door 25 while the section that is shaped like an elephant's trunk, being folded, prevents any input of contamination.

It deserves to be noted that one advantage of the container of the invention is that it is possible to select films of different natures for the two bags: they can therefore be selected with complementary natures, since the inner bag is designed to be the cleanest possible while the primary function of the outer bag is to be a protective envelope, whose degree of cleanliness is secondary relative to the degree of cleanliness desired for the inner bag. It is thus that the material that constitutes the inner bag can be produced in a material that is already validated for its qualities of compatibility with the products that are designed to be inserted there while the material that constitutes the outer bag can be selected for its ability to be used as a barrier, its behavior when empty, its impermeability to oxygen, to steam, etc.; it can involve in particular a multilayer material.

By way of example, the inner bag is made of a polyethylene film with a high degree of cleanliness, with a thickness on the order of 80 to 120 microns, while the outer bag can be made of a polyethylene-polyamide-polyethylene multilayer with a thickness that is approximately equal to on the order of 100 microns.

The inner bag 10 is basically longer than the outer bag 20, which makes it possible to fold the section that is shaped like an elephant's trunk while making it possible that the portion of maximum width of this inner bag be just shorter than the outer bag (it is observed in FIG. 5 that the portion of maximum width of the inner bag occupies approximately three-quarters of the length of the outer bag and comprises a trapezoidal portion for transition toward the section that is shaped like an elephant's trunk that is almost completely located behind the fold of the inner bag).

Since the section that is shaped like an elephant's trunk is folded, it is basically jammed into the outer bag during the filling of the inner bag, through the access door 25.

It is only at the time of transporting the contents of the inner bag to the outside that the operator opens the second door 27, grabs the section that is shaped like an elephant's trunk that passes under this door, and pulls it toward the outside, to unfold it and to make it possible for the products or items to exit toward the outside, for example to the inside of another chamber with an opening from which the access door 27 will have been attached. The elephant's trunk shape allows a good flow of the products when the latter are liquid or in powder form, or when the items are very small pieces.

It is understood that the section that is shaped like an elephant's trunk is preferably just smaller than that of the access door so as to promote the exit of the products and items.

For the sake of convenience, provision can be made to make the two bags integral by an external welding along the dotted lines 30, close to the left openings of the two bags, which makes it possible to prevent the inner bag from being the only one to support the load of the products or items to be transported or to be treated. Provision can also be made to make the two bags integral by an outside welding along the dotted lines 31 close to the folded end of the inner bag, which promotes holding the inner bag in folded position during its filling via the door 25. Provision can, of course, be made that there are seams close to each of the ends of the outer bag, so as to prevent any significant input of contamination between the two inner and outer bags.

However, it is understood that it is not necessary to close the outer bag to ensure a good level of cleanliness of the inside of the inner bag, primarily if the section that is shaped like an elephant's trunk is provided a great length, typically of between 20% and 33% of the length of the outer bag (in the example shown, the section that is shaped like an elephant's trunk has a length that represents on the order of one quarter of the length of the set of two bags).

It is noted that thus only the holding quality of the particles of the inner bag is significant, since the protection of the products is ensured by the outer bag. At the time of the preparation of the inner bag, only the fact of making the ring slide by opening the casing partway is likely to allow contamination, but the latter can be eliminated if this operation is carried out in a clean room. In addition, when the inner bag is slid into the outer bag to ratchet the male part of the door 25 in the ring, the portion of the inner bag that is exposed before this ratcheting can be deionized.

By following this process, it is noted that only the surface of the inner wall of the inner bag that faces the hole that is made with the hollow punch can be contaminated whereas all of the remaining inner surface of the inner bag remains sheltered from any contamination. The ratio between the two surfaces, namely the surface of the hole and the entire inner surface of the inner bag, defines the risk of degradation of the cleanliness of the inner surface of the inner bag, relative to the level of cleanliness of a bag that is directly closed in a clean room, but this ratio may be very low, and the risk of contamination can be minimized by precautions taken when the two bags are assembled.

The invention claimed is:

1. A flexible shipping container configured for single use, for sterile application and for transporting items, comprising:

an inner bag, configured to hold the items, formed by a first casing that is closed at one, first end and including another, second end shaped as an elephant trunk and configured to be folded toward the first end into a folded state;

and an outer bag in which the inner bag is configured to be housed, the outer bag being formed by a second casing comprising a single-use first access door extending through a wall of the inner bag and a wall of the outer bag and being located close to the closed first end of the inner bag, the first access door being configured to be permanently locked after a single use in which the items from outside of the flexible shipping container are loaded, and a single-use second access door extending only through the wall of the outer bag and being located close to the second end of the inner bag in the folded state of the second end, the second access door being configured to remain permanently in an opened state during and after the single use in which the items from the inner bag are unloaded to the outside of the flexible shipping container by the second end of the inner bag;

wherein when the inner bag is filled with the items through the single-use first access door, the second end of the inner bag is configured to be folded into the folded state and be inserted into the outer bag, the second end of the inner bag is smaller than the second access door, and the second end of the inner bag is configured to be pulled toward the outside of the flexible shipping container through the single-use second access door in the opened state of the second access door and unfolded when the items disposed within the inner bag are transported to the outside of the flexible shipping container.

2. The container according to claim 1, wherein the second folded end of the inner bag is narrower than a remaining portion of the inner bag.

3. The container according to claim 2, wherein the inner bag has a width that is at most equal to a width of the outer bag.

4. The container according to claim 2, wherein the inner bag and the outer bag are connected close to the first closed end of the inner bag.

5. The container according to claim 1, wherein the inner bag has a width that is at most equal to a width of the outer bag.

6. The container according to claim 5, wherein the inner bag and the outer bag are connected close to the first closed end of the inner bag.

7. The container according to claim 1, wherein the inner and outer bags are connected close to the first closed end of the inner bag.

8. The container according to claim 7, wherein the inner bag and outer bag are connected by welding.

9. The container according to claim 1, wherein the inner bag and the outer bag are connected close to the second folded end of the inner bag.

10. The container according to claim 1, wherein the inner bag and the outer bag are each made of different materials with respect to the other, a first material having a particulate holding capacity and a second material having mechanical protection properties.

11. The container according to claim 1, wherein the second end shaped as the elephant trunk is opened and becomes closed when the second end is folded toward the first end.

12. The container according to claim 1, wherein the flexible shipping container is configured to transport small items.

13. A process for manufacturing the container according to claim 1, the process comprising:

forming the first casing and extending, in the first casing and close to the first end of the first casing, a hole through a single wall of the first casing;

sliding a ring inside the first casing from the first end before the first end is closed so as to extend through the hole; and forming the second casing with two holes therethrough, the first access door engaged in one of the holes, and the second access door engaged in the other hole, the first access door being connected by ratcheting to the ring and the second access door being close to the folded end of the first casing after the inner bag of the flexible shipping container is inserted into the outer bag of the flexible shipping container.

14. The process according to claim 13, wherein the first casing and the second casing are connected close to at least one of the ends of the first casing.

15. The process according to claim 14, wherein the first casing is made of a first material and the second casing is made of a second, different material, the first material having a particulate holding capacity and the second material having mechanical protection properties.

16. The process according to claim 13, wherein the first casing is made of a first material and the second casing is made of a second, different material, the first material having a particulate holding capacity, and the second material having mechanical protection properties.

* * * * *

UNITED STATES PATENT AND TRADEMARK OFFICE

CERTIFICATE OF CORRECTION

PATENT NO. : 8,523,436 B2
APPLICATION NO. : 12/599897
DATED : September 3, 2013
INVENTOR(S) : Armau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 669 days.

Signed and Sealed this
Fifteenth Day of September, 2015

Michelle K. Lee

Michelle K. Lee
*Director of the United States Patent and Trademark Office*